United States Patent [19]

Budnovitch et al.

[11] 4,293,898

[45] Oct. 6, 1981

[54] GARDEN LIGHT FIXTURE

[75] Inventors: William F. Budnovitch, Summit; Salvatore C. Petralia, Sayreville; Louis F. Silvestris, Bayonne, all of N.J.

[73] Assignee: Keene Corporation, Union, N.J.

[21] Appl. No.: 93,273

[22] Filed: Nov. 13, 1979

[51] Int. Cl.[3] ..... F21J 7/00

[52] U.S. Cl. ..... 362/291; 362/302; 362/304; 362/342

[58] Field of Search ..... 362/291, 302, 304, 342

[56] References Cited

U.S. PATENT DOCUMENTS 4,096,553 6/1978 Lasker ..... 362/342

*Primary Examiner*—Stephen J. Lechert, Jr.

*Attorney, Agent, or Firm*—Gerald Levy

[57] ABSTRACT

A garden light fixture is provided comprising a cylindrical housing about which a plurality of shades extend. The intermediate and top shade are secured to the housing by means of keyways formed integral with the shades which engage and are captured by slots formed in the housing.

8 Claims, 3 Drawing Figures

GARDEN LIGHT FIXTURE

BACKGROUND OF THE INVENTION

The present invention relates to light fixtures and in particular to outdoor garden lights.

A type of outdoor garden light fixture which is extremely popular comprises a transparent cylinder about which a series of spaced downwardly sloping shades extend. The fixture is somewhat oriental in appearance and sometime known as a chinese lantern or pagoda fixture. Such fixtures are often mounted close to the ground along a path or adjacent steps. The shades serve to protect the fixture from rain and snow and simultaneously to prevent upward glare while still permitting the fixture to illuminate the path or stairway.

Heretofore the shades on such fixtures were connected to each other and supported by a series of rods disposed about a transparent cylindrical housing. The housing in turn was secured to a support member. In order to service such fixtures it was necessary to disassemble the rods connecting the shade. In many cases this is an awkward as well as time consuming procedure. Another objection to such fixtures is that the rods tend to block some of the light with the result that shadows may form along the path being illuminated.

In view of the above, it is a principal objective of the present invention to provide an improved fixture of the type described wherein the annular shades may more readily be assembled to the transparent housing than heretofore has been possible.

A further object is to provide such a fixture wherein access to the fixture socket may be readily attained without necessitating disassembling of a major portion of the fixture.

A still further object is to provide a fixture of the type described wherein the shade supporting rods are eliminated and thus improving the illumination available from the fixture and reducing the cost of the fixture.

Still further objects and advantages will become evident from the following description of the invention.

SUMMARY OF THE INVENTION

The above and other beneficial objects and advantages are attained in accordance with the present invention by providing a garden light fixture of the type described wherein the transparent cylindrical housing is formed with circumferential grooves extending thereabout. In addition, the cylindrical housing includes a pair of grooves extending axially from the circumferential grooves to the open end of the cylinder. The annular shades are provided with keyways which extend into their inner opening. The keys are positioned to align with the axial grooves and to be captured by the circumferential grooves. The top shade member is provided with a cap which closes the open top end of the cylinder. Thus, access to the interior of the housing may readily be attained by merely twisting the top shade member until its keyways align with the axial grooves and thereafter lifting the shade member off the housing.

DETAILED DESCRIPTION OF THE PREFERRED EMBODIMENT

Figure 1:
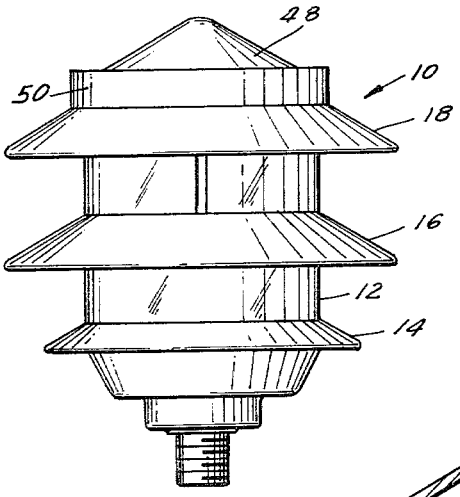
FIG. 1 is a perspective view of a garden light fixture in accordance with the present invention.

Reference is now made to the drawings and to FIG. 1 in particular wherein a fixture 10 in accordance with the present invention is depicted. It will be noted, the fixture 10 comprises a generally cylindrically transparent housing 12 about which a series of downwardly sloping annular shades extend. In this preferred embodiment, three shades are shown including a bottom shade 14, an intermediate shade 16 and a top shade 18.

Figure 2:
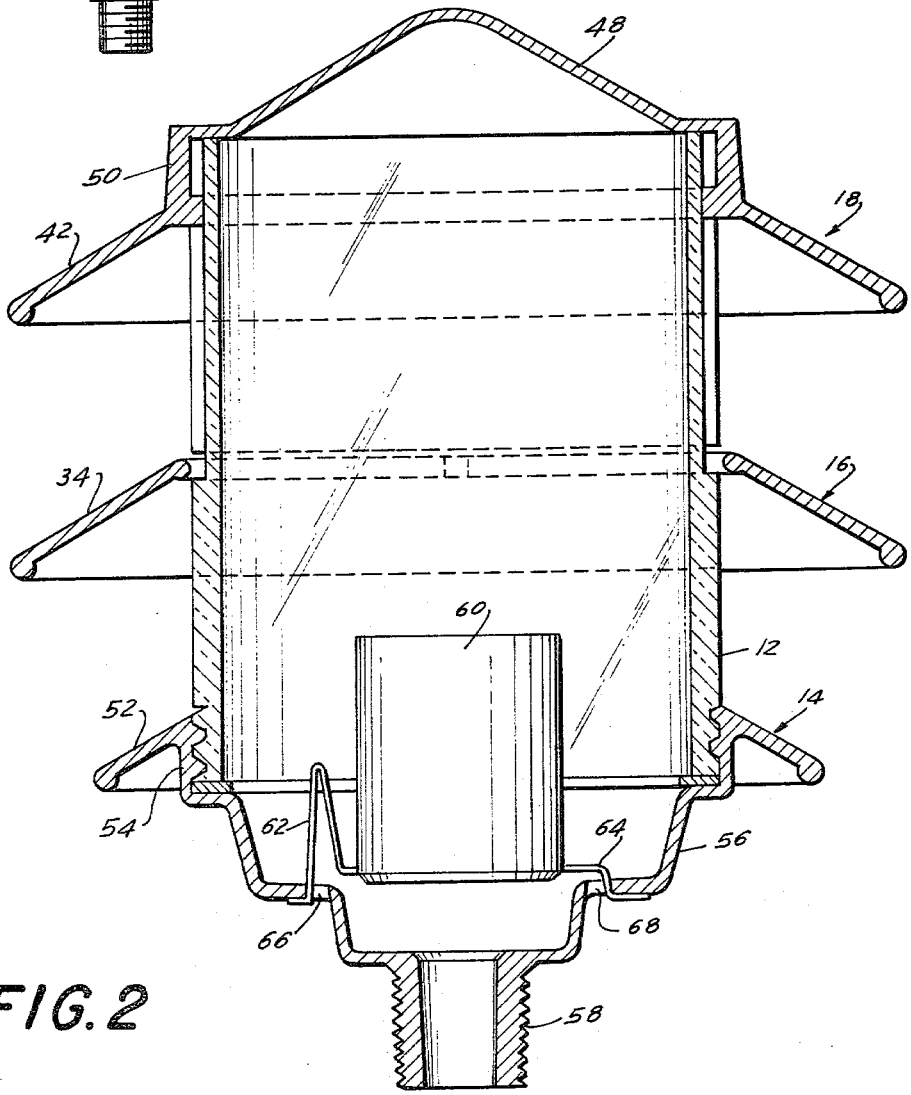
FIG. 2 is a side elevational sectional view of the fixture of FIG. 1.
Figure 3:
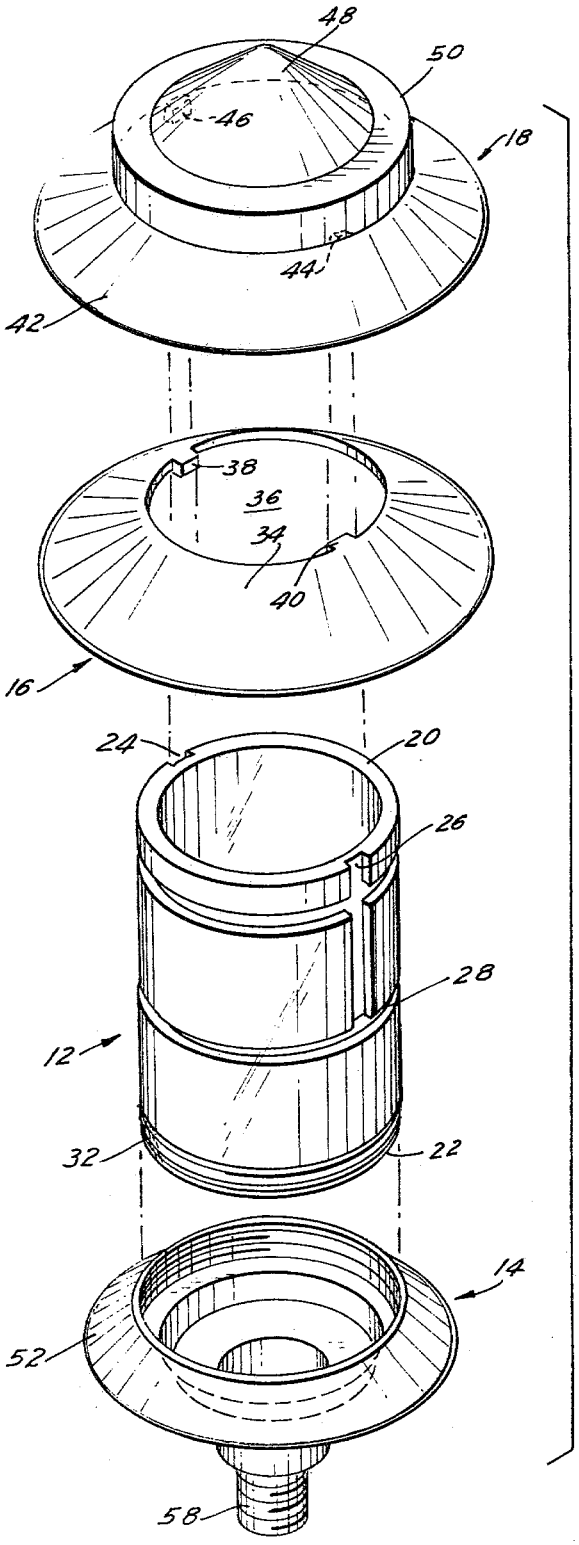
FIG. 3 is an exploded perspective view of the components of the fixture of the present invention.

Referring to FIGS. 2 and 3, it can be seen that cylinder 12 is open at its top end 20 and bottom end 22. The cylinder may be formed of glass or a suitable heat resistance transparent plastic material. As will be seen, a pair of diametrically opposed grooves 24 and 26 extend from the open top end 20 of cylinder 12 to a circumferential groove 28 extending about the cylinder. A second groove 30 also extends circumferentially about the exterior of the cylinder and is intersected by the axial grooves 24 and 26. The grooves 24, 26, 28 and 30 are all of substantially the same width and depth which, in the preferred embodiment is approximately ½ the thickness of the cylindrical member. The lower portion of cylinder 12 is provided with external threads 32 which extend outwardly from the bottom end 22. It should be noted that the groove 28 is approximately at the midpoint of cylinder 12.

Each of the shade members 14, 16 and 18 comprises a generally annular shade member which slopes downwardly from its inner diameter towards its outer diameter. The downwardly sloping shades enable the fixture to shed rain and snow and also serve to direct the illumination from the lamp contained within the fixture (not shown) downwardly so that if the fixture is mounted close to the ground there would be no upward glare to a passer-by.

Referring to shade 16, it can be seen that the shade comprises an annular member 24 having an inner opening 36 into which keyways 38 and 40 extend. The keyways 38 and 40 are dimensioned to fit within grooves 24 and 26 for longitudinal movement and within groove 28 to permit rotation. To this end, the keyways 38 and 40 are diametrically opposite each other so as to register with grooves 24 and 26.

The construction of shade 18 is substantially identical with that of shade 16 in that it includes an annular member 42 as well as keyways 44 and 46 extending inwardly from the inner diameter. Member 18, however, is additionally provided with a peaked cap 48 which fits over a rim 50 extending upwardly from the inner diameter of shade member 42. As shown in FIG. 2, the height of rim 50 is such as to enable the cap 48 to fit over and thereby close the top end of cylindrical housing 12 when the keyways 44 and 46 are captured by circumferential groove 30. The bottom shade 14 includes an annular shade member 52 provided with a collar 54 which extends downwardly from its inner diameter. The interior surface of collar 54 is threaded to mate with the threads 32 at the lower end of housing 12. Member 14 is also provided with an integral support section 56 which extends downwardly from the lower end of collar 54. The support section includes a hollow threaded stem 58 which may be secured to a section of conduit or an electrical junction box in a conventional manner. The electrical connections are brought through stem 58 to a socket 60 which is mounted by clips 62 and 64 through appropriate openings 66 and 68 in member 56. A lamp (not shown) is conveniently screwed into socket 60.

An important feature of the present invention is the ease of assembly of the fixture. To this end, shade 14 is connected to a conduit or junction box through stem 58 and the leads are brought to socket 60. The threaded portion 32 of transparent cylinder 12 is then screwed to collar 54 of member 14 thereby securing the cylinder 12 to member 14. Shade 16 is then positioned over the top end of cylinder 12 with keyways 38 and 40 registering with grooves 24 and 26. Member 16 is then guided downwardly until keyways 38 and 40 rest in circumferential groove 28. A slight twist of member 16 then disengages the keyways 38 and 40 from grooves 24 and 26 thereby preventing the removal of member 16. The assembly of the fixture is then completed by aligning keyways 44 and 46 with grooves 24 and 26 and then permitting member 18 to fall until the keyways 44 and 46 engage circumferential groove 30. This serves to close the open end of cylinder 12 as well as to provide the top deflecting shade member 42. A slight twist of member 18 disengages keyways 44 and 46 from grooves 24 and 26 locking the shade in place and serving to prevent the inadvertent removal of member 18.

To replace a lamp, all that need be done is to twist member 18 until keyways 44 and 46 once again align with grooves 24 and 26. The entire member 18 may then be lifted off cylinder 12 thereby providing access to the interior of the fixture and permitting the simple removal and replacement of a lamp.

As stated, cylinder 12 may be formed of glass or a suitable, heat resistant plastic material. Similarly, the shades 14, 16 and 18 may be formed from a metal such as aluminum or a suitable plastic material.

Thus, in accordance with the above, the objects of the present invention are effectively attained. Although the present invention has been described with a single intermediate shade member 16, it should be appreciated that additional intermediate members may be readily provided by extending the length of longitudinal grooves 24 and 26 to additional suitable circumferential grooves.

We claim:

1. A light fixture comprising:

a transparent cylindrical housing having open top and bottom ends;

at least one groove extending circumferentially about said housing intermediate said top and bottom ends;

at least one groove extending axially along said cylinder from said circumferential groove to one of said ends;

and at least one shade having a generally annular member including an inner opening substantially equal in diameter to that of said cylinder and at least one keyway extending into said inner opening, said keyway being dimensioned to fit into said cylindrical housing axially and circumferential grooves;

whereby said one shade may be locked into position about said housing when said one keyway is in said circumferential groove but not within said axial groove and said one shade may be positioned for removal by rotating said shade until said keyway is positioned within said axial groove.

2. The fixture in accordance with claim 1 further comprising a second groove extending axially along said cylinder from said circumferential groove to said one end and a second keyway on said shade extending into said inner opening, said second axial groove and second keyway being positioned on said cylinder and shade respectively to register when said one keyway and one axial groove register.

3. The fixture in accordance with claim 1 or 2 further comprising a cap member affixed to said one shade member and capping said inner opening, a rim extending between said shade and said cap member, said rim being sufficiently long so that said cap member closes said housing top end when said shade keyway engages said one circumferential groove.

4. The fixture in accordance with claim 2 further comprising a second circumferential groove extending about said cylinder, said axially extending grooves extend to said second circumferential groove from said cylinder top end; a second shade having a generally annual member including an inner opening substantially equal in diameter to that of said cylinder; and said second shade has a pair of keyways extending into said inner opening and positioned to register with said cylinder axial grooves whereby said second shade may be locked into position about said housing when said second shade keyways are in said second circumferential groove but not within said axially extending grooves and said second shade may be positioned for removal by rotating said second shade until its keyways are positioned within said axial grooves.

5. The fixture in accordance with claim 4 wherein one of shade members further includes a cap member affixed thereto and capping said inner opening, a rim extending between said shade and said cap member, said rim being sufficiently long so that said cap member closes said housing open top end when said one shade member keyways engage the circumferential groove closest said cylinder top end.

6. The fixture in accordance with claim 5 wherein said cylinder includes threads extending circumferentially thereabout from the bottom end thereof and further comprising a third shade having a generally annular member including an inner opening generally equal in diameter to said cylinder, a collar disposed about said third shade member opening, said collar having threads thereon adapted to mate with said cylinder threads.

7. The fixture in accordance with claim 6 further comprising support means for said fixture extending downwardly from said third shade.

8. The fixture in accordance with any of claims 1, 2, 4 or 6 wherein each of said shade members slopes downwardly from its inner opening.

* * * * *

UNITED STATES PATENT AND TRADEMARK OFFICE

CERTIFICATE OF CORRECTION

PATENT NO. : 4,293,898

DATED : October 6, 1981

INVENTOR(S) : William F. Budnovitch et al

It is certified that error appears in the above-identified patent and that said Letters Patent are hereby corrected as shown below:

At Column 4, Claim 4, line 6 "annual" should read

-- annular --

Signed and Sealed this

Second Day of March 1982

[SEAL]

Attest:

GERALD J. MOSSINGHOFF

Attesting Officer

Commissioner of Patents and Trademarks